United States Patent [19]

Perlin

[11] Patent Number: 4,571,761

[45] Date of Patent: Feb. 25, 1986

[54] CUT AWAY LOUNGE AND/OR BED

[76] Inventor: Samuel Perlin, 11 Stirrup La., Roslyn, N.Y. 11577

[21] Appl. No.: 667,809

[22] Filed: Nov. 2, 1984

[51] Int. Cl.[4] ..... A47C 27/12; A47C 11/00

[52] U.S. Cl. ..... 5/431; 5/448; 269/322; 297/458

[58] Field of Search ..... 5/431, 448, 436, 60, 5/481, 434; 297/458, 459; D6/382, 595, 596, 605; 269/328, 324, 322

[56] References Cited

U.S. PATENT DOCUMENTS

| | | | |
|---|---|---|---|
| D. 249,360 | 9/1978 | Lacock | D6/382 |
| 3,813,091 | 5/1974 | Metzger | 269/322 |
| 4,193,150 | 3/1980 | Vineberg | 5/431 |
| 4,373,222 | 2/1983 | Wolfe et al. | 269/328 |

*Primary Examiner*—Alexander Grosz
*Attorney, Agent, or Firm*—Michael I. Kroll

[57] ABSTRACT

A cut away lounge and/or bed for providing a new and more comfortable means of copulation is provided and consists of a frame and a mattress, each having cut away areas formed on opposite sides so that the man can lie horizontally back on the mattress and the woman can stand vertically over the man with her thighs fitting into the cut away areas making closer contact possible between the man and the woman during sexual intercourse, with greater comfort to the woman.

As a lounge the device may be covered with a permanent type of puffed material thus eliminating the need of a mattress.

6 Claims, 4 Drawing Figures

CUT AWAY LOUNGE AND/OR BED

BACKGROUND OF THE INVENTION

1. Field of Invention

The instant invention relates generally to lounges and/or beds and more specifically it relates to a cut away lounge and/or bed for providing a new and more comfortable means of copulation.

2. Description of the Prior Art

Numerous lounges and/or beds such as vibration, water and adjustable, have been provided in prior art that are adapted to perform different types of functions. While these prior art units may be suitable for the particular purpose to which they address, they would not be suitable for the purposes of the present invention as heretofore described.

SUMMARY OF THE INVENTION

A principal object of the present invention is to provide a cut away lounge and/or bed that allows a man to more completely penetrate a woman during sexual intercourse when the man lies horizontally back on the lounge and/or bed and the woman stands vertically with her thighs fitting into the cut away areas of the lounge and/or bed so that closer contact may be had with greater comfort to the woman.

Another object is to provide a cut away lounge and/or bed that contains a head rest incorporated into the lounge and/or bed to aid the man when he lies horizontally back on the lounge and/or bed so that he can better view the woman during sexual intercourse.

An additional object is to provide a cut away lounge and/or bed that has the cut away areas off center so that the man can lie horizontally back on the lounge and/or bed with his legs bent and feet placed upon the floor to get better leverage during sexual intercourse.

A further object is to provide a cut away lounge and/or bed that is simple and easy to use.

A still further object is to provide a cut away lounge and/or bed that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
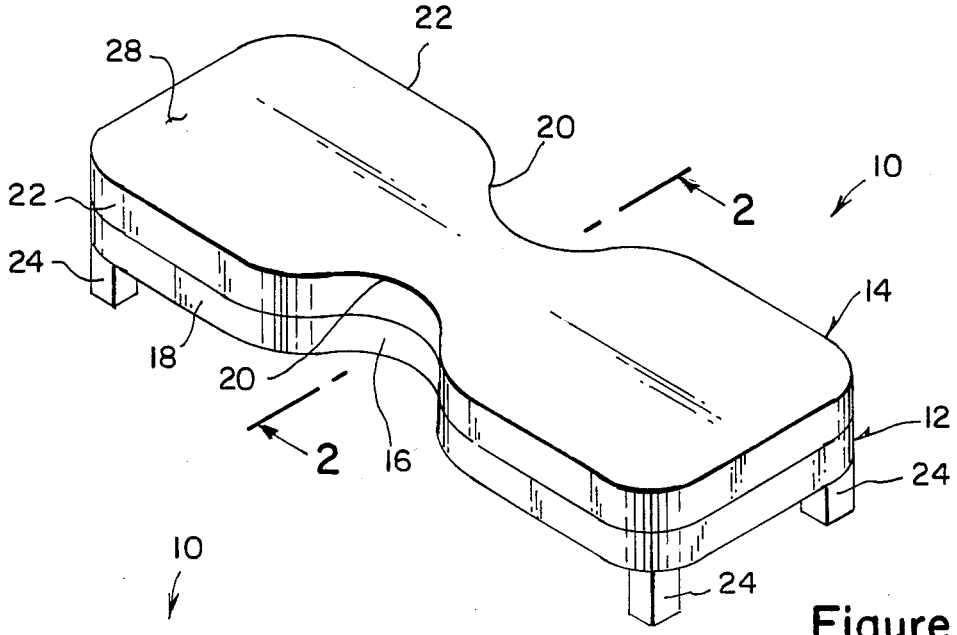
FIG. 1 is a perspective view of the invention.
Figure 2:
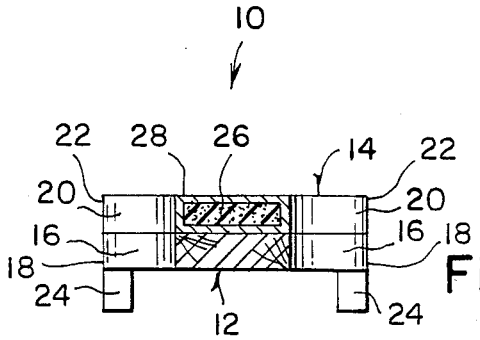
FIG. 2 is a cross sectional view taken along line 2—2 in FIG. 1.

Turning now descriptively to the drawings, in which similar reference characters denote similar elements throughout the several views, FIGS. 1 and 2 illustrates a cut away lounge and/or bed 10 for allowing a man (not shown) to more easily penetrate a woman (not shown) during sexual intercourse. The lounge and/or bed 10 consists of a frame 12 and a mattress 14. The frame 12 has two cut away areas 16. Each cut away area 16 is formed on an opposite side 18 of the frame 12. The mattress 14 also has two cut away areas 20. Each cut away area 20 is formed on an opposite side 22 of the mattress 14.

The mattress 14 is placed upon the frame 12 with the cut away areas 16, 20 in alignment. The man can lie horizontally back on the mattress 14 and the woman can stand vertically over the man with her thighs fitting into the cut away areas 16, 20 of both the frame 12 and the mattress 14 making closer contact possible between the man and the woman during sexual intercourse, with greater comfort to the woman.

Four legs 24 are supplied to support and elevate the frame 12. The mattress 14, as best seen in FIG. 2, further consists of a foam rubber inner layer 26 conforming to the shape of the mattress 14 and a material outer layer 28 also conforming to the shape of the mattress 14. The foam rubber inner layer 26 and the material outer layer 28 provide comfortable support for the man during sexual intercourse. As a lounge, the frame 12 may be covered with a permanent inherent puffed material (not shown) eliminating the need of the mattress 14, thus making it look more like a sofa.

Figure 3:
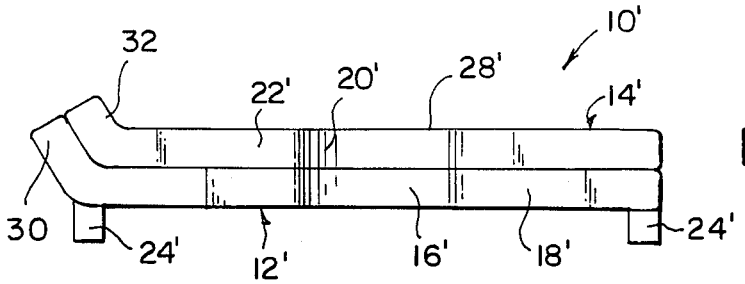
FIG. 3 is a side view of a first modification showing a head rest incorporated into the invention.

In FIG. 3 the frame 12' of a first modified cut away lounge and/or bed 10' is bent at its head portion 30 thus forming a head rest out of head portion 32 of the mattress 14' to aid in the comfort of the man when he lies horizontally back on the mattress 14' to better view the woman during sexual intercourse.

Figure 4:
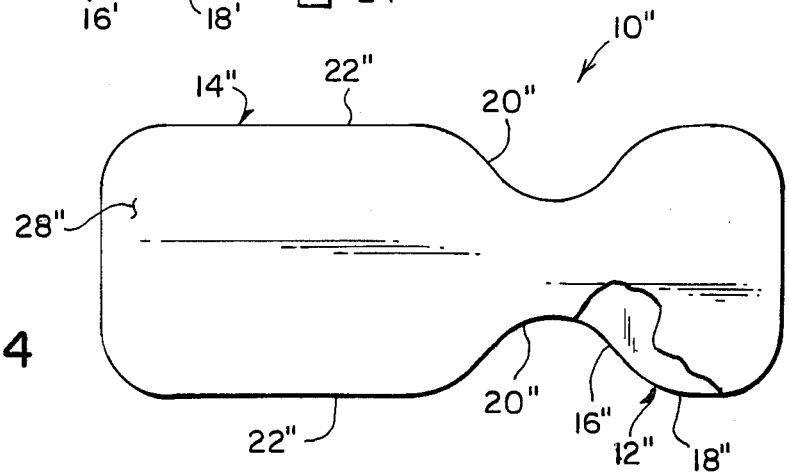
FIG. 4 is a top view of a second modification with parts broken away showing the cut away areas off center.

As best seen in FIGS. 1 and 3 the cut away areas of the frames 12 or 12' and the mattresses 14 or 14' are centrally formed on their opposite sides. The man can lie horizontally back on either mattress 14 or 14' with his legs upon the mattress. In FIG. 4 a second modified cut away lounge and/or bed 10'' is shown wherein the cut away areas 16'' and 20'' of the frame 12'' and the mattress 14'' are formed off center on opposite sides 18'' and 22''. The man can now lie horizontally back on the mattress 14'' with his legs bent at his knees and his feet placed upon the floor to get better leverage during sexual intercourse.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A cut away lounge and/or bed for providing a new and more comfortable means of copulation which comprises:

(a) a rigid one piece non-adjustable frame, substantially horizontal at least in its area other than the head portion, having two cut away areas, each said cut away area formed on an opposite side of said frame so that said frame assumes an hour glass configuration; and (b) a mattress, substantially horizontal at least in its area other than the head portion, having two cut away areas, each said cut away area formed on an opposite side of said mattress so that said mattress assumes an hour glass configuration, said mattress being placed upon said frame with said cut away areas in alignment, the top surface of the mattress being sufficiently vertically spaced from a supporting surface on which the frame rests so that a man can lie horizontally back on said mattress and a woman can stand on said supporting surface, vertically over said man with her thighs fitting into said cut away areas of both said frame and said mattress making closer contact possible between said man and said woman during sexual intercourse, with greater comfort to the woman.

2. A cut away lounge and/or bed for providing a new and more comfortable means of copulation as recited in claim 1, further comprising a plurality of legs to support and elevate said frame.

3. A cut away lounge and/or bed for providing a new and more comfortable means of copulation as recited in claim 2, wherein said mattress further comprises:

(a) a foam rubber inner layer conforming to shape of said mattress; and (b) a material outer layer conforming to shape of said mattress whereby said foam rubber inner layer and said material outer layer provide comfortable support for said man during sexual intercourse.

4. A cut away lounge and/or bed for providing a new and more comfortable means of copulation as recited in claim 3, wherein said frame is bent at its head portion thus forming a head rest out of head portion of said mattress to aid in the comfort of said man when he lies horizontally back on said mattress to better view said woman during sexual intercourse.

5. A cut away lounge and/or bed for providing a new and more comfortable means of copulation as recited in claim 4, wherein said cut away areas of said frame and said mattress are centrally formed on said opposite sides so that said man can lie horizontally back on said mattress with his legs upon said mattress.

6. A cut away lounge and/or bed for providing a new and more comfortable means of copulation as recited in claim 3, wherein said cut away areas of said frame and said mattress are formed off center on said opposite sides so that said man can lie horizontally back on said mattress with his legs bent at his knees and his feet placed upon the floor to get better leverage during sexual intercourse.

* * * * *